US006371003B1

(12) United States Patent
Hickey

(10) Patent No.: US 6,371,003 B1
(45) Date of Patent: Apr. 16, 2002

(54) ENCLOSURES FOR INSTALLATION ON THE SEABED

(75) Inventor: Christopher Daniel Dowling Hickey, Balcombe (GB)

(73) Assignee: Lawborough Consultants Limited (GB)

( * ) Notice: Subject to any disclaimer, the term of this patent is extended or adjusted under 35 U.S.C. 154(b) by 0 days.

(21) Appl. No.: 09/689,765

(22) Filed: Oct. 13, 2000

(30) Foreign Application Priority Data

Oct. 13, 1999 (GB) ..... 9924246

(51) Int. Cl.[7] ..... F41F 3/07
(52) U.S. Cl. ..... 89/1.81; 89/1.809; 102/411
(58) Field of Search ..... 89/1.809, 1.81; 102/399, 411; 367/1

(56) References Cited

U.S. PATENT DOCUMENTS

| | | | |
|---|---|---|---|
| 1,853,379 | A | 4/1932 | Rotinoff |
| 2,931,187 | A | 5/1960 | Perkins |
| 3,035,285 | A | 5/1962 | Squires |
| 3,072,022 | A | 1/1963 | Wood et al. |
| 3,137,203 | A | 6/1964 | Brown |
| 3,158,062 | A | 11/1964 | Feiler |
| 3,279,319 | A | 10/1966 | Semonian et al. |
| 3,301,132 | A | 1/1967 | Lehmann et al. |
| 3,499,364 | A | 3/1970 | D'ooge |
| 3,916,634 | A | 11/1975 | Woodruff |
| 4,274,333 | A | 6/1981 | Lampton |
| 4,395,952 | A | 8/1983 | Hickey |
| 4,566,367 | A | 1/1986 | Hickey |
| 4,586,421 | A | 5/1986 | Hickey |
| 5,837,919 | A | 11/1998 | Yagla |
| 6,044,745 | A | 4/2000 | Hickey ..... 89/1.809 |

FOREIGN PATENT DOCUMENTS

| | | |
|---|---|---|
| EP | 0 110 554 | 6/1984 |
| EP | 0844963 | 6/2000 |
| WO | WO 97/07017 | 2/1997 |

*Primary Examiner*—Ian J. Lobo
(74) *Attorney, Agent, or Firm*—Smith Gambrell & Russell, LLP

(57) ABSTRACT

The disclosure relates to an enclosure for installation in the seabed comprising an elongate container for holding a payload. The container has a plurality of passages extending lengthwise of the container and an impeller at the lower end of the container for drawing water through at least one or said passages to form a slurry with the material of the seabed and for discharging the slurry at the upper end of the container into the surrounding water. The enclosure has inner and outer concentric passageways extending lengthwise thereof and said impeller has a blade or blades extending across the inner and outer passageways. The blade of the impeller has a first portion pitched to draw water down one of the passageways to the lower end of the container and a second portion pitched to discharge slurry up the other of the passageways to the top of the container.

15 Claims, 4 Drawing Sheets

ENCLOSURES FOR INSTALLATION ON THE SEABED

BRIEF DESCRIPTION OF THE INVENTION

1. Field of the Invention

This invention relates to enclosures for installation on the seabed to carry communications and/or weapon systems to be deployed from the seabed.

SUMMARY OF THE INVENTION

2. Description of the Prior Art

European Patent Specification No. 0110554 discloses an underwater weapon system comprising an elongate outer container which is buried or partially buried in the seabed in an upright position using self-burying means which are at the bottom end of the container and which preferably comprise both pump means for removing sand or silt and rotary material displacing means, e.g. an auger for boring a hole in the seabed or rotary stirring means. The weapon is a self-propelled device with guidance means and is housed within an inner container which is telescopically arranged within the outer container.

U.S. Patent Specification No. 6044745 discloses an enclosure for instalation on the seabed comprising an outer cylindrical container one of the which is more buoyant than the other so that the container lies in a vertical orientation when disposed in the sea and auger devices at the other end of the container for activating sand/silt/shingle on the seabed to create a cavity below the container into which the container can self-bury. The container has a payload compartment within the container for holding weaponry, listening, identification recording and/or communications equipment. The container wall is formed with a plurality of separate passages extending spirally from inlets at the lower end of the container upwardly to outlets at the top of the container through which activated sand/silt/shingle and water generated at the lower end of the container can flow upwardly and freely as the container self-buries in the seabed.

According to a first aspect, the invention provides an enclosure for installation in the seabed, comprising an elongate container for holding a payload, the container having a plurality of passages extending lengthwise of the container and impeller means at one end-of the container to be the lower end of the container on installation for drawing water through at least one of said passages from the other end of the container to form a slurry with the material of the seabed and for discharging slurry formed at said one end of the container through at least one other of said passages to said other end of the container for discharge into the surrounding water.

Preferably the enclosure has inner and outer concentric passageways extending lengthwise thereof and said impeller has a blade or blades extending across the inner and outer passageways, the blade or blades having a first section pitched to draw water down one of the passageways and a second portion pitched to discharge slurry up the other of the passageways.

More specifically the impeller may be rotatable about an axis which is co-axial with the axes of the inner and outer concentric passageways, inner portions of the blade or blades of the impeller being pitched to draw water down the inner passageway and the outer portion of the blade or blades of the impeller being pitched to propel slurry up the outer passageway.

In one particular arrangement the outer passageway may have an annular outlet port partway up the container for the discharge of slurry outwardly of the container.

In any of the above arrangements the payload may include a motor for driving the impeller and a power supply for the motor.

Also in any of the above arrangements the payload may include communication means for receiving/transmitting signals which may be sonar, acoustic or seismic.

The payload may also include a weapon system or systems.

Turning now to further aspects of the invention, worldwide, there are perhaps some several hundred of Mine Hunting Vessels (MHVs) either in existence or under construction. All are designed to a very high standard, costly to build and loaded with even more expensive equipment. They rely on complex and heavy sweep gear, hull mounted sonars, variable depth sonars (Vds), remotely operated vehicles (ROVs) and unmanned underwater vehicles (UUVs) to act as "eyes" when trying to find, identify, and neutralise targets. MHVs and other ancillary vehicles therefore constitute the "point of the spear head" in any amphibious landing or mine clearance operation. Such assets are not easily replaceable.

Currently the only way to find articles such as maritime mines whether moored to or buried in the sea bed is, as indicated, to use various types of sonars.

Some sonars may perhaps even be mounted on ROVs or UUVs and which for each of designation, are hereinafter referred to as "scouts".

The situation is therefore much as follows. All ships generate signals, even when anchored, dead in the water, or if under way, by various means e.g.:

(a) Seismic Signals (b) Noise which may be either (i) Vessel General Signals ("VGS")

(I) Sonar Generated Signals ("SGS")

(c) Pressure changes (d) Anomalous magnetic signals (MAD)

Sensors already exist which will register-respond, to any one, a combination, or all four of these signals.

Even with the use of "scouts" the useful range at which objects may be detected by sonar is limited, perhaps to say 1,000 to fifteen hundred yards at best, and, without VDS, down to a depth of say 50 fathoms or so. The field of vision or "swathe" is similarly restricted. Clearance rates are therefore slow, and progress is pedestrian.

In consequence mine clearance is a difficult task even against old fashioned moored and/or contact mines, particularly when coming up against decoys and/or ship count. The situation is not eased if the MHVs are also subject to airborne and other forms of attack, and/or operating under less than ideal sea conditions.

Now, if to all the foregoing hazards is added a self propelled sonar/acoustic signal riding weapon, which is programmed to "Hunt the Hunters" e.g. the subject of EP-B-0844963 and which being "passive" will detect the "active" searching sonar signal, from whatever source, e.g. MHV or Scout, at twice the range at which the weapon of 0844963 itself can be detected, then the task of mine clearance becomes immeasurably more difficult, and the likely costs to even the most determined aggressor, will hopefully be prohibitive.

Nevertheless some may try, and the following is a further invention will further deter any that do attempt to overcome the arrangement of EP-B-0844963.

Thus according to a further aspect the invention provides an underwater communication device comprising means to detect a signal generated by a vessel in the vicinity of the device and means responsive to receipt of such signal to transmit a decoy sonar signal to the vessel.

It is proposed that in order to deter, confuse intruding vessels, a series of units (referred to herein after as "Lorelei") designed to be buried or partially buried/planted in the sea bed, and which will detect and respond to the various signals which will be generated by intruding vessels should be deployed in and around maritime mine fields. They would be particularly effective when deployed in conjunction with the sea bed unit described and illustrated in EP-B-0844963.

Each unit which could be constructed of or coated with non reflective materials, will contain the necessary electronic equipment e.g. receivers, sensors, hydrophones, magnetometers, transducers, transponders, signal generators, aerials, transmitters etc. to enable it not only to accept coded instructions, which might be either seismic or acoustic in origin, but also to ensure that when alerted/activated by the presence of an intruding vessel or decoy, either surface or subsurface, that the signals, particularly such sonar signals emanating from the intruder may:

(a) be received copied, analysed, classified modulated or amplified before being re-transmitted, if, or as required, alternatively, (b) spurious synthesised signals purporting to be the reflecting echo of different varieties, types, shapes, of mine could be generated and transmitted, as could that of a submarine or running torpedo in order to confuse-blind the searching vessels.

In the same way, such units could also be deployed in the littorals, and/or remote areas, where they could be used as a covert early warning system. They too could be alerted by say:

(a) Seismic signals, followed by (b) Acoustic and/or magnetic anomaly signals (c) Pressure generated signals. These signals cannot currently, be synthesised, and would therefore be extremely useful in confirming the class of vessel, submarines for instance have a particularly distinctive pressure pattern signature, and with the units tuned accordingly, would be comparatively easy to plot!

Having intercepted the various signals emanating from vessels and confirming say, that it is a submarine, the unit could release a buoyant radio beacon which would:

(a) transmit a uniquely coded radio signal, thereby confirming its authenticity, before it would (b) self destruct and release a calcium carbide float, and/or fluorescent coagulate dye which would spread across the surface of the sea, and which would therefore, be visible to the "satellite" tracking systems. Different coloured dyes might be used:

(i) to identify different types of vessels, and/or (I) to indicate time of release.

In this way the course of a submarine could be charted from the time it leaves its base. The use of "decoy dyes" by vessels would be precluded by the need for the dye release to match with the "unique coded identification signal".

Battery life will be important in such units, therefore the arrangement could be programmed to listen for instructions at pre-determined times, rather than maintain at a constant listening watch. Instructions would be coded and might for instance initiate one of the following pre-programmed modes, e.g.:

(a) remain dormant unit . . . or (b) await further instructions which will be issued at pre-determined intervals or (c) become active, for a period, or permanently, or (d) set to anti handling mode, or (e) self destruct if breaking from its mooring, or if so instructed.

BRIEF DESCRIPTION OF THE DRAWINGS

The following is a description of a specific embodiment of the invention, reference being made to the accompanying drawings in which.

DESCRIPTION OF THE PREFERRED EMBODIMENTS

Figure 1:
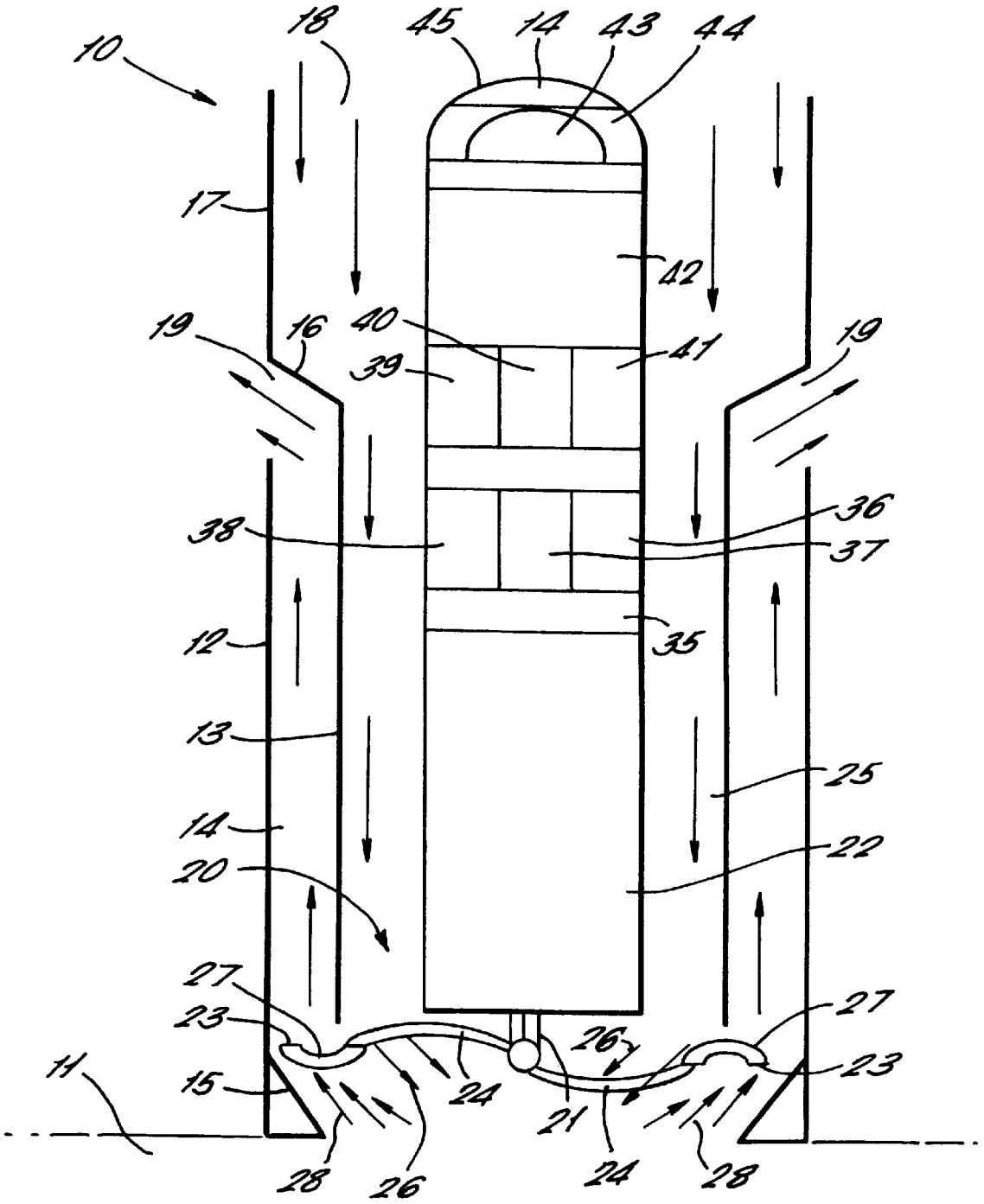
FIG. 1 is a diagrammatic view of an enclosure to be installed in the seabed to hold communications or weaponry systems having an impeller system at its lower end and to displace material on the seabed for self-burying of the enclosure.

The drawing shows an enclosure indicated generally at 10 for installation at a strategic location on the seabed which is indicated at 11. The enclosure comprises outer and inner concentric containers 12, 13 and an inner payload assembly indicated generally at 14 which will be described in greater detail below.

The inner and outer containers define between them an outer annular passageway 12*a* extending between the containers from the top to the lower end of the enclosure. The outer container has a nozzle plate 15 mounted within the end of the container to direct spoil from the surface of the seabed into the outer passageway 12*a* as indicated by the arrows.

An inner annular passageway 13*a* is formed between the inner container 13 and the payload assembly extending through the enclosure. Towards the upper end of the enclosure, the inner container 13 is stepped outwardly at 16 to form an enlarged upper end 17 having an open entry indicated at 18 at the top of the enclosure to receive water to flow downwardly through the passageway 13*a* in the direction of the arrows.

The outer container 12 terminates at its upper end below the step 16 to provide an annular outlet port 19 for release of slurry passing up the outer passageway 12*a* to the surrounding sea.

The payload assembly 14 includes an impeller assembly indicated generally at 20 having a drive shaft 21 mounted co axially with the axis of the inner and outer containers in the lower part 22 of the payload assembly which also contains a battery powered electric motor for rotating the shaft. The impeller has laterally extending blades 23, each of which has an inner section 24 extending across the lower end of the inner passage 13*a* immediately below the inner container 13 and pitched to draw water down the passage 25 from the inlet end 18 at the top of the enclosure. The water is directed by the blade portions 24 in the direction of the arrows 26 inwardly and downwardly onto the seabed 11 below the payload assembly to fluidise the material of the seabed with water.

The outer portions 27 of the blades are pitched to draw the fluidised seabed material upwardly from the central region below the payload assembly in the direction of the arrows 28 into the outer passage 12*a* between the inner and outer containers and upwardly to the outlet 19. Thus the single impeller generates a downward flow of water in the inner passage 25 and an upward flow of a slurry of material from the seabed and water in the outer passage 12*a* to excavate the seabed immediately below enclosure 10. By excavating the seabed below the enclosure, the enclosure is allowed to drop progressively into the seabed thereby burying itself to avoid both detection and damage from equipment or implements being drawn over the seabed.

The payload assembly 14 of the enclosure may contain a variety of different communications/weapon systems. By way of example, the assembly may include a signal generator unit 35, a process unit 36, an analyser unit 37, a control unit 38, vessel generated acoustic signal receivers 39, sonar generated acoustic signal receivers 40, transmitter units (sonar, acoustic, seismic) 41, a buoyancy hydrophone chamber 42, directional transducer 43, an acoustic imaging transducer 44 and a pressure detection unit 45. A variety of other equipment and/or weapons may be carried.

Figure 2:
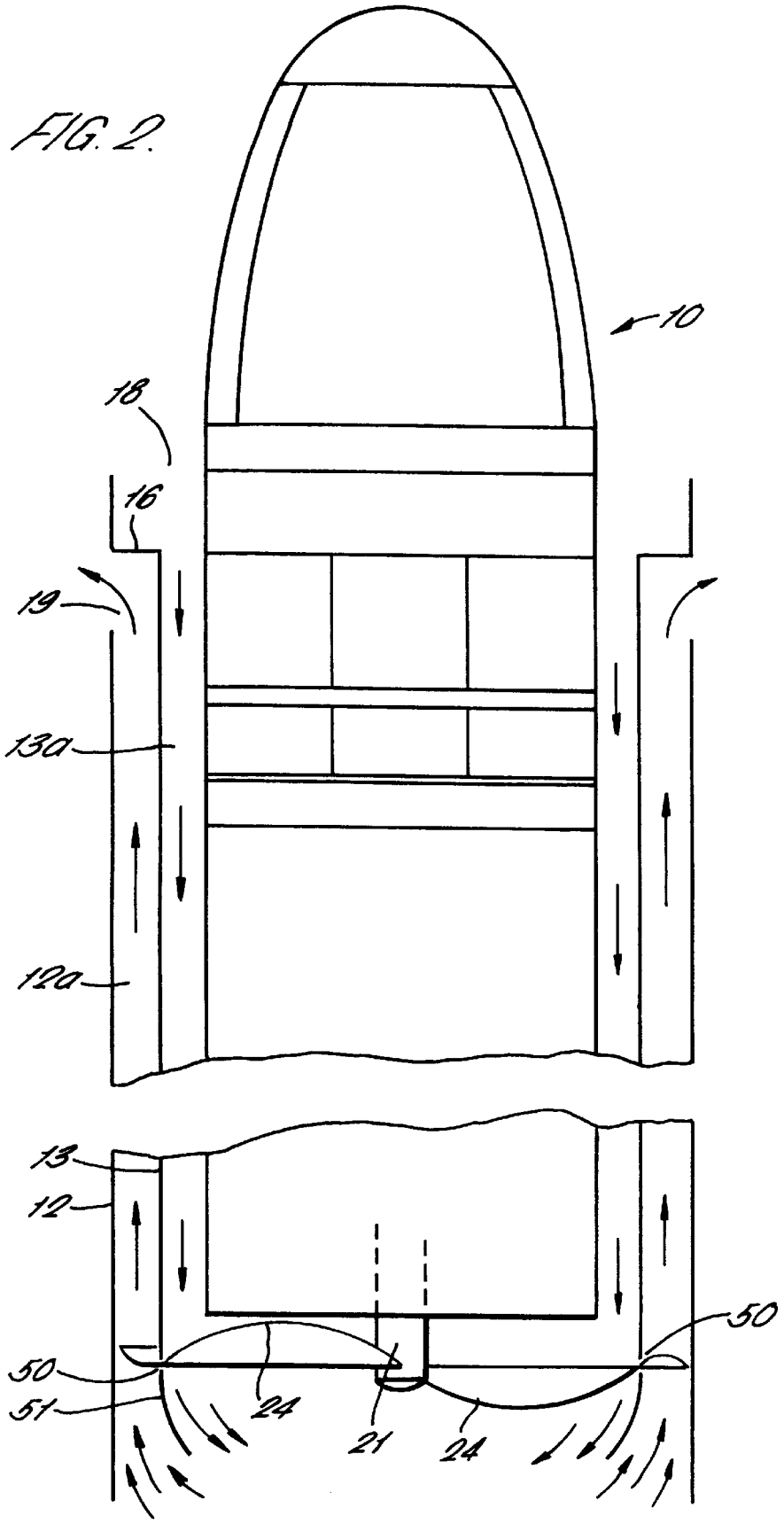
FIG. 2 is a diagrammatic view of a similar enclosure having a modified impeller arrangement.
Figure 3:
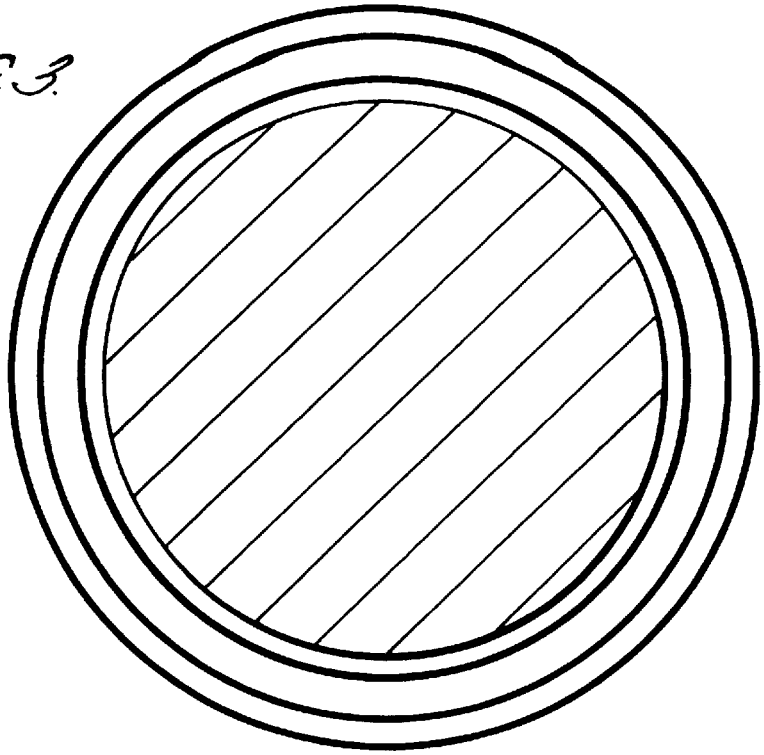
FIG. 3 is a plan view of the enclosure of FIG. 2.
Figure 4:
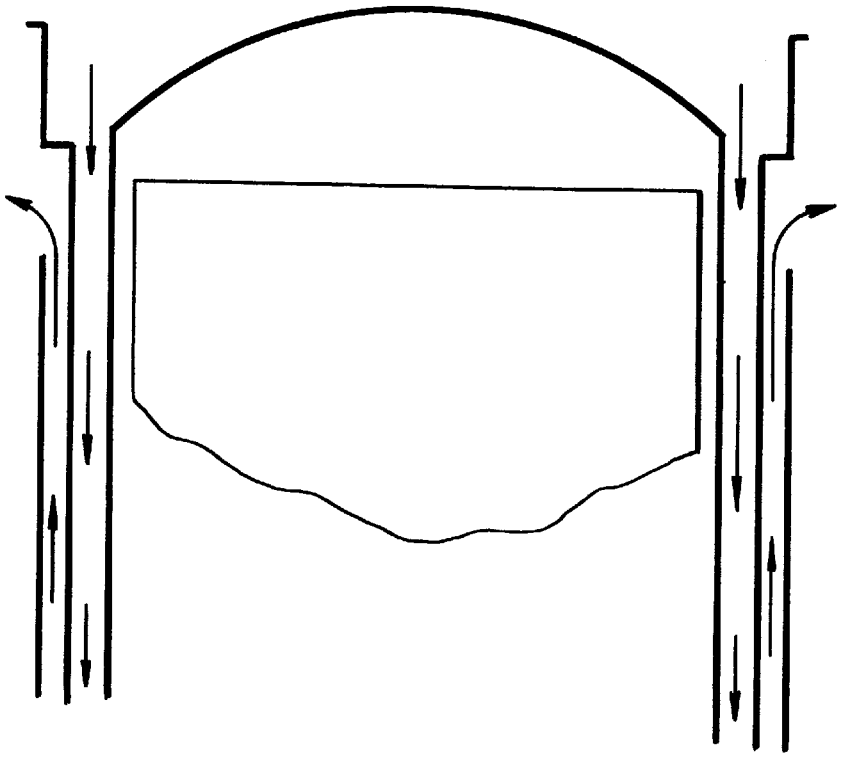
FIG. 4 is a detailed view of the lower end of the enclosure showing the impeller arrangement at its lower end.
Figure 5:
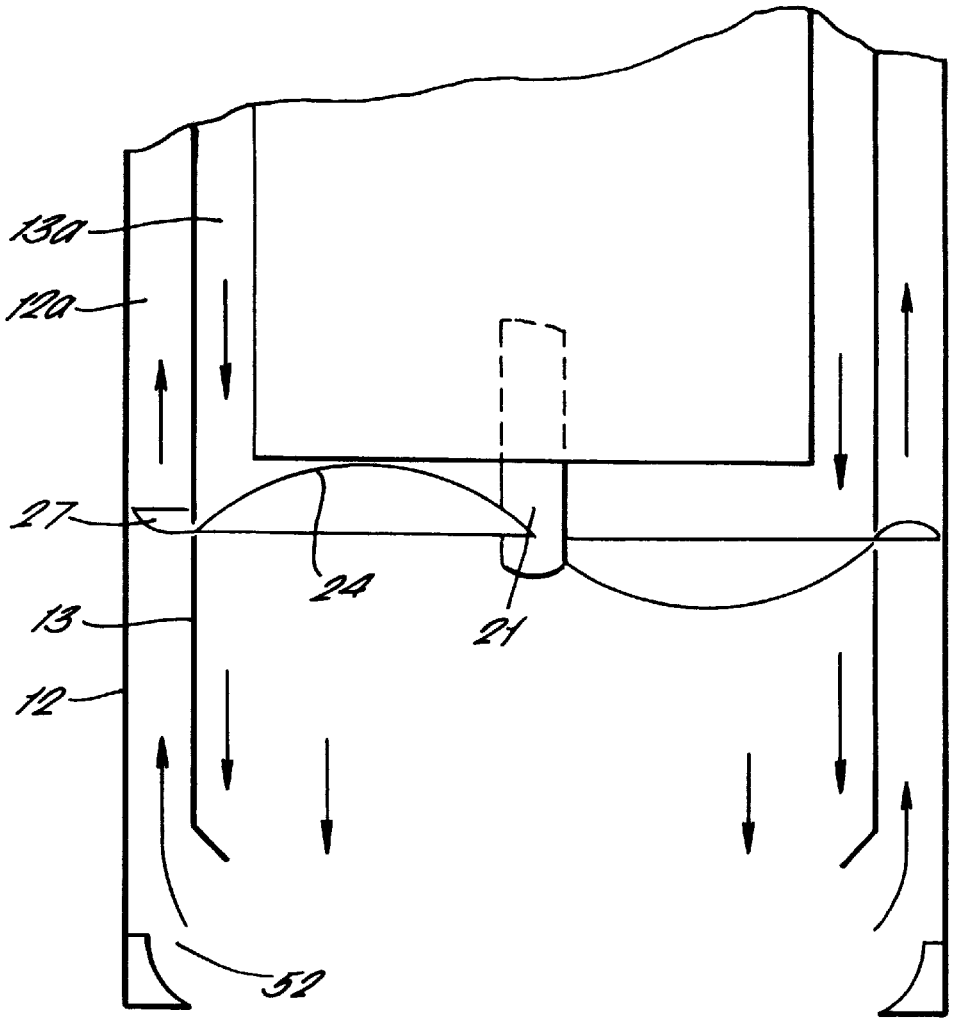
FIG. 5 shows a further modified arrangement.

FIGS. 2 to 4 show a modified form of the enclosure in which the lower part of the container wall 13 below the payload 14 has an annular slit 50 through which the impeller extends to operate the outer passageway 12a. Also the lower end of the container 13 has an inwardly curved exit 51 to direct water inwardly as indicated by the arrows. In FIG. 5 the lower end of the container is angled inwardly as indicated at 52 for the same purpose.

It is proposed that in order to deter, confuse intruding vessels, a series of units designed to be buried or partially buried/planted in the sea bed, and which will detect and respond to the various signals which will be generated by intruding vessels should be deployed in and around maritime mine fields. They would be particularly effective when deployed in conjunction with the sea bed unit described and illustrated in EP-B-0844963.

Each unit which could be constructed of or coated with non reflective materials, will contain the necessary electronic equipment e.g. receivers, sensors, hydrophones, magnetometers, transducers, transponders, signal generators, aerials, transmitters etc. to enable it not only to accept coded instructions, which might be either seismic or acoustic in origin, but also to ensure that when alerted/activated by the presence of an intruding vessel or decoy, either surface or subsurface, that the signals, particularly such sonar signals emanating from the intruder may:

(a) be received copied, analysed, classified modulated or amplified before being re-transmitted, if, or as required, alternatively, (b) spurious synthesised signals purporting to be the reflecting echo of different varieties, types, shapes, of mine could be generated and transmitted, as could that of a submarine or running torpedo in order to confuse-blind the searching vessels.

In the same way, such units could also be deployed in the littorals, and/or remote areas, where they could be used as a covert early warning system. They too could be alerted by say:

(a) Seismic signals, followed by (b) Acoustic and/or magnetic anomaly signals (c) Pressure generated signals. These signals cannot currently, be synthesised, and would therefore be extremely useful in confirming the class of vessel, submarines for instance have a particularly distinctive pressure pattern signature, and with the units tuned accordingly, would be comparatively easy to plot!

Having intercepted the various signals emanating from vessels and confirming say, that it is a submarine, the unit could release a buoyant radio beacon which would:

(a) transmit a uniquely coded radio signal, thereby confirming its authenticity, before it would (b) self destruct and release a calcium carbide float, and/or fluorescent coagulate dye which would spread across the surface of the sea, and which would therefore, be visible to the "satellite" tracking systems.

Different coloured dyes might be used:

(i) to identify different types of vessels, and/or (I) to indicate time of release.

In this way the course of a submarine could be charted from the time it leaves its base. The use of "decoy dyes" by vessels would be precluded by the need for the dye release to match with the "unique coded identification signal".

Battery life will be important in such units, therefore the arrangement could be programmed to listen for instructions at pre-determined times, rather than maintain at a constant listening watch. Instructions would be coded and might for instance initiate one of the following pre-programmed modes, e.g.:

(a) remain dormant unit . . . or (b) await further instructions which will be issued at pre-determined intervals or (c) become active, for a period, or permanently, or (d) set to anti handling mode, or (e) self destruct if breaking from its mooring, or if so instructed.

It will be appreciated that if the units are deployed in multiples, then a searching MHV will receive a multiplicity of signals in response to each signal which it has generated and transmitted.

Provision is also made to enable the units to automatically tune to any frequency that the searching vessel chooses to use. Alternatively, each Lorelei could be programmed on/to a specific range of frequencies, and a quantity of them could thereby cover the whole of the likely spectrum.

When deployed in conjunction with EP-B-0844963, there could be communication between the two, if desired, thus if necessary the transmission of the spurious signals may be delayed sufficiently to allow the system to plot the course of say an MHV, and "lock on" before launching its weapon, thereby avoiding the intentional confusion which is being caused by the multiplicity of spurious signals being transmitted by Lorelei. However and in addition, the system is already programmed to switch from the Sonar Riding mode to tracking by Vessel Generated Noise and this facility could easily be called up in necessary.

In consequence whilst the MHV remains effectively blinded by a cloud of "synthetic sonar clutter" and is therefore, at risk of collision with moored mines which now it cannot "see/identify". It is also open to attack by the hunter type weapon launched from the system of EP-B-0844963.

Bearing in mind that without changing the laws of physics it is virtually impossible even now, to locate the weapon of EP-B-0844963 any aggressor will find it both difficult and costly in men and ships when attempting a clearance operation, when confronted by both weapon systems.

Equally to be confronted by the present system alone, in a suspected mined area, or even in a conventional moored type minefield, should sensibly induce a degree of caution in the most determined aggressor, and this must be of value to a defender.

Recently there have been many "informed" articles on mine counter measures, and how the latest technology will solve the problems associated with finding, identifying, and destroying/neutralising maritime mines. Currently there is significant and ongoing expenditure on M.C.M.Vs and sonars, all of which is of course essential, if the fashionable concept of "Projection of Power from the Sea", is to become a practical reality. However in view of the existence of having the above weapon systems Capital Ships, Mine Hunting Vessels, and all their associates sonars may be rendered obsolescent, in which case it may be time to "think again" in regard to future naval strategy, this time paying due regard to later technology which is now freely available.

What is claimed is:

1. An enclosure for installation in the seabed comprising an elongate container for holding a payload, the container having a plurality of passages extending lengthwise of the container and impeller means at one end of the container which is the lower end of the container on installation for drawing water down at least one of said passages from the upper end of the container to form a slurry with the material of the seabed and for delivering slurry formed at said one end of the container through at least one other of said passages to said upper end of the container for discharge into the surrounding water.

2. An enclosure as claimed in claim 1, wherein the enclosure has inner and outer concentric passageways extending lengthwise thereof and said impeller has a blade or blades extending across the inner and outer passageways, the blade or blades having a first portion pitched to draw water down one of the passageways and a second portion pitched to discharge slurry up the other of the passageways.

3. An enclosure as claimed in claim 2, wherein the impeller rotates about an axis which is co-axial with the axes of the inner and outer concentric passageways, inner portions of the blade or blades of the impeller being pitched to draw water down the inner passageway and the outer portion of the blade or blades of the impeller being pitched to propel slurry up the outer passageway.

4. An enclosure as claimed in claim 3, wherein the outer passageway has an annular outlet port partway up the container for the discharge of slurry outwardly of the container.

5. An enclosure as claimed in claim 1, wherein the payload includes a motor for driving the impeller and a power supply for the motor.

6. An enclosure as claimed in claim 5 wherein the power supply for the motor is provided in the enclosure or, as a remote vessel, surface or submarine, coupled to the enclosure by an umbilical cable.

7. An enclosure as claimed in claim 1, wherein the payload includes communication means for receiving/transmitting signals which may be sonar, acoustic or seismic.

8. An enclosure as claimed claim 1, wherein the payload includes a weapon system or systems.

9. An enclosure for installation in the seabed comprising an elongate container for holding a payload, the container having a plurality of passages extending lengthwise of the container and impeller means at one end of the container which is the lower end of the container on installation for drawing water down at least one of said passages from the upper end of the container to form a slurry with the material of the seabed and for delivering slurry formed at said one end of the container through at least one other of said passages to said upper end of the container for discharge into the surrounding water, and wherein the enclosure has inner and outer concentric passageways extending lengthwise thereof and said impeller has a blade or blades extending across the inner and outer passageways, the blade or blades having a first portion pitched to draw water down one of the passageways and a second portion pitched to discharge slurry up the other of the passageways.

10. An enclosure as claimed in claim 9, wherein the irpeller rotates about an axis which is co-axial with the axes of the inner and outer concentric passageways, inner portions of the blade or blades of the impeller being pitched to draw water down the inner passageway and the outer portion of the blade or blades of the impeller being pitched to propel slurry up the outer passageway.

11. An enclosure as claimed in claim 10, wherein the outer passageway has an annular outlet port partway up the container for the discharge of slurry outwardly of the container.

12. An enclosure as claimed in claim 9, wherein the payload includes a motor for driving the impeller and a power supply for the motor.

13. An enclosure as claimed in claim 12 wherein the power supply for the motor is provided in the enclosure or, as a remote vessel surface or submarine, coupled to the enclosure by an umbilical cable.

14. An enclosure as claimed in claim 9, wherein the payload includes conmmunication means for receiving/transmitting signals which may be sonar, acoustic or seismic.

15. An enclosure as claimed claim 9, wherein the payload includes a weapon system or systems.

* * * * *